US008596475B2

(12) United States Patent
Kobert et al.

(10) Patent No.: US 8,596,475 B2
(45) Date of Patent: Dec. 3, 2013

(54) ADAPTER COUPLER FOR ADAPTING COUPLINGS OF DIFFERENT DESIGN

(75) Inventors: Siegfried Kobert, Holle (DE); Kay Uwe Kolshorn, Wolfenbuttel (DE); Dirk Behrens, Halberstadt (DE)

(73) Assignee: Voith Patent GmbH, Heidenheim (DE)

( * ) Notice: Subject to any disclaimer, the term of this patent is extended or adjusted under 35 U.S.C. 154(b) by 215 days.

(21) Appl. No.: 13/099,537

(22) Filed: May 3, 2011

(65) Prior Publication Data

US 2011/0274480 A1 Nov. 10, 2011

(30) Foreign Application Priority Data

May 4, 2010 (EP) ..... 10161829

(51) Int. Cl.
*B61G 1/00* (2006.01)

(52) U.S. Cl.
USPC ..... 213/75 R; 213/178; 213/93

(58) Field of Classification Search
USPC ..... 213/75 R, 78, 82, 84, 93, 95, 98, 100 R, 213/175, 178
See application file for complete search history.

(56) References Cited

U.S. PATENT DOCUMENTS

| | | | | |
|---|---|---|---|---|
| 7,604,136 | B2 * | 10/2009 | Kontetzki | 213/75 R |
| 8,297,454 | B2 * | 10/2012 | Kolshorn et al. | 213/75 R |

FOREIGN PATENT DOCUMENTS

| | | | |
|---|---|---|---|
| FR | 2473447 | A1 | 7/1981 |
| GB | 862072 | A | 3/1961 |
| GB | 899772 | A | 6/1962 |
| GB | 1065050 | A | 4/1967 |

OTHER PUBLICATIONS

First Official Action mail date Apr. 28, 2013 for Application No. 201110120045.9 for Voith Patent GmbH filed on May 4, 2011 with English translation, 18 pages.

* cited by examiner

*Primary Examiner* — Zachary Kuhfuss
(74) *Attorney, Agent, or Firm* — Cesari and McKenna, LLP

(57) ABSTRACT

An adapter coupler (1) for adapting couplings of different design, wherein the adapter coupler (1) comprises a first connecting mechanism for releasably connecting the adapter coupler (1) to a first coupling, a second connecting mechanism for releasably connecting the adapter coupler (1) to the drawhook (50) of a second coupling, and a coupler housing (2) for connecting the first connecting mechanism to the second connecting mechanism, and wherein the second connecting mechanism comprises a tension yoke (8) with which to engage with the drawhook (50) of the second coupling. The adapter coupler (1) having a mechanism for height centering, comprising a drawbar eye (14) connected to the coupler housing (2), wherein the drawbar eye (14) is arranged and configured relative the tension yoke (8) such that upon the adapter coupler (1) being inserted into the jaw of the drawhook (50) of the second coupling, the drawhook (50) can engage in one joint process with both the accommodation formed by the tension yoke (8) as well as with the drawbar eye (14).

25 Claims, 8 Drawing Sheets

ADAPTER COUPLER FOR ADAPTING COUPLINGS OF DIFFERENT DESIGN

BACKGROUND OF THE INVENTION

1. Field of the Invention

The invention relates, in general, to an adapter coupler and in particular to an adapter coupler for adapting couplings of different design.

2. Background Information

The adapter coupler of interest comprises a first connecting mechanism for the releasable connecting of the adapter coupler to a first coupling, a second connecting mechanism for the releasable connecting of the adapter coupler to the drawhook of a second coupling, as well as a coupler support to connect the first connecting mechanism to the second connecting mechanism, wherein the second connecting mechanism comprises a tension yoke, with the tension yoke having a first and a second support connectable to a tension bolt such that an accommodation is formed to receive the drawhook of the second coupling.

The adapter coupler of interest may connect different couplings between an automatic central buffer coupling and a screw-type coupling, wherein the first connecting area of the adapter coupler can be configured as a coupler lock for the releasable connecting of the adapter coupler to the coupler head of an automatic central buffer coupling and wherein the second connecting area of the adapter coupler can be configured as a coupling link to be inserted into the drawhook of a screw-type coupling for the releasable connecting of the adapter coupler to the coupler head of a screw-type coupling.

The term "connecting area" as used herein is generally to be understood as an interface between the coupler support of the adapter coupler on the one side and the coupling to be connected with the adapter coupler on the other. The connecting area can for example be configured as or comprise a coupler lock for the releasable connecting of the adapter coupler to the coupler head of an automatic central buffer coupling. On the other hand, it is conceivable for the connecting area to comprise a coupling link which can be inserted into the drawhook of a screw-type coupling. Of course, other embodiments of the connecting area are also conceivable.

An adapter coupler of this type is known in general in railway technology and is used to connect rail-borne vehicles equipped with differing coupling systems (e.g. a Scharfenberg coupler to a drawhook). The adapter coupler is usually manually connected to e.g. the drawhook, while the coupling process can be automatic in the case of a central buffer coupling.

A conventional adapter coupler for the mixed-use coupling between an automatic central buffer coupling and for example a screw-type coupling usually comprises a coupler support configured at least partly as a housing in which a coupler lock can be accommodated as the first connecting mechanism for mechanically connecting the adapter coupler to a coupler lock provided in the coupler head of an automatic central buffer coupling. In the coupled state, the front face of the adapter coupler then abuts the front face of the automatic central buffer coupling's coupler head.

A coupling link which can be received for example in the drawhook of a screw-type coupling can be provided as a second connecting mechanism on the end opposite the front face of the adapter coupler and thus provide a mechanical connection of the adapter coupler to the screw-type coupling.

In operation, tractive and compressive forces are introduced into the second connecting mechanism of the adapter coupler configured as a coupling link from the drawhook of the screw-type coupling. The compressive forces introduced into the coupling link, the second connecting mechanism respectively, are conducted through the coupler support to the front face of the adapter coupler and from there, transmitted to the front face of the automatic central buffer coupling's coupler head mechanically connected to the adapter coupler.

Tractive forces, on the other hand, are transmitted through the first connecting mechanism such as the automatic central buffer coupling. The coupler locks can for example comprise a core piece pivotably mounted relative the coupler support by means of a main pin and having a coupling eye articulated thereto. Tractive force is thereby transmitted by the respective coupling eyes which engage in the corresponding core pieces.

It is to be noted at this point that the present invention is by no means limited to an adapter coupler designed to connect an automatic central buffer coupling to a screw-type coupling. Rather, the invention relates to an adapter coupler for adapting couplings of differing design in general, wherein the adapter coupler comprises a connecting mechanism compatible with a coupling of a first design type and configured to form a releasable connection with the coupling of the first design type, and wherein the adapter coupler further comprises a second connecting mechanism compatible with a coupling of a second design type having a drawhook and configured to form a releasable connection with the coupling of the second design type.

An adapter coupler of the type cited at the outset as known from the prior art is depicted in a side view in FIG. 1 and in a perspective view in FIG. 2. In the depicted embodiment, the adapter coupler 101 is positioned onto the drawhook 50 of a screw-type coupling to be adapted. To this end, both rear sides of the adapter coupler 101 are provided with identically-constructed supports 103, 103' arranged at a spacing and parallel to one another and connected together at their free ends by a pin 104 which holds the adapter coupler 101 in the jaw of the drawhook 50.

A bell-crank lever 105 is arranged on both sides of the conventional adapter coupler 101. A first limb 105*a* of the bell-crank lever 105 is designed to be telescopically adjustable. As depicted for example in FIG. 1, the first limb 105*a*, which is held in the extended position by a pressure spring 109, is articulated to the adapter coupler 101. A second limb 105*b* of the bell-crank lever 105 is configured as a rigid arm. The first and second limbs 105*a*, 105*b* are connected together at their respective free ends by a common yoke 107. A positioning nut 106 having a recessed cap-like crosspiece 108 on the underside for bearing on the lug of the drawhook 50 is guided centrically through the yoke 107. The limbs 105*a*, 105*b* on both sides of the adapter coupler 101 are connected to and interconnected with one another by means of a common shank 110, wherein the shank 110 serves as the contact surface at the front face of drawhook 50 so that the vertical angular position of the adapter coupler 101 about pin 104, and thus the central position of the adapter coupler 101, can be adjusted by adjusting the crosspiece 108.

The provision of the bell-crank lever 105 enables a centering of height to be realized in the adapter coupler 101 known from the prior art. However, the manual process to do so, and in particular the manual inserting of the adapter coupler 101 into the interface between the couplings to be adapted, for example into the drawhook 50 of a screw-type coupling, is difficult since it is not possible for a user to hold the weight of the adapter coupler 101 on the one hand and properly position the height-centering mechanism at the drawhook 50 on the other.

On the basis of this problem as posed, the present invention is based on the object of providing an adapter coupler of the type cited at the outset having a height-centering mechanism, wherein despite said height-centering mechanism, the manual manipulating of the adapter coupler is simplified.

SUMMARY OF THE INVENTION

This object is solved by the subject matter of independent claim 1.

The adapter coupler according to the invention thus in particular comprises a mechanism for height centering which incorporates a drawbar eye connected to the coupler housing of the adapter coupler. Said drawbar eye is arranged and configured relative the tension yoke such that upon the adapter coupler being inserted into the jaw of the drawhook, the drawhook can engage in one joint process with both the tension yoke as well as with the drawbar eye.

The advantages attainable with the inventive solution are many. Providing a drawbar eye connected to the coupler support of the adapter coupler for height centering the adapter coupler, which is designed and configured respective the tension yoke so as to receive the lug of the drawhook when the tension yoke is inserted into the drawhook, requires only one step in order to position and mount the adapter coupler to the second coupling to be adapted. The tension yoke of the adapter coupler and the drawbar eye provided for height centering are arranged and configured respective one another such that when the adapter coupler is inserted into the jaw of the drawhook, the tension yoke engages with the drawhook and the drawbar eye concurrently receives the lug of the drawhook. Thus it is also possible for a single person to position the adapter coupler with relatively little effort since the drawbar eye provided for height centering receives the lug of the drawhook quasi automatically as soon as the tension yoke of the adapter coupler is placed into the jaw of the drawhook.

The inventive solution is further characterized by the simple design to the height-centering mechanism such that fewer components are needed in comparison to a conventional adapter coupler (see for example the adapter coupler depicted in FIG. 1 or FIG. 2), which results in lowering the weight of the adapter coupler.

Advantageous developments of the inventive solution are set forth in the dependent claims.

In order to have the drawhook engage with the tension yoke in one joint process when the adapter coupler is inserted into the jaw of the drawhook while the drawhook lug is concurrently received by the drawbar eye, it is in particular conceivable for the drawbar eye to be configured and oriented relative to the accommodation formed by the tension yoke such that the parallel projection of the drawbar eye and the parallel projection of the accommodation at least partly overlap on a horizontal plane of projection.

For example, to form the tension yoke, one realization of the inventive solution provides for the second connecting mechanism to comprise two preferably parallel supports with a horizontally-aligned tension bolt connecting said supports, wherein the drawhook of the second coupling can be received in the area between these two parallel supports. In this realization, the drawbar eye should preferably be provided on the upper side of the coupler support and at least partly align substantially axially with the area between the two supports. This facilitates the manipulating of the adapter coupler since the adapter coupler is usually inserted into the drawhook of a coupling to be adapted from above. Of course, other realizations are also conceivable.

In order to achieve the height centering of the adapter coupler in an easily-realized yet effective manner, a preferred development provides for the drawbar eye to be connected to the coupler support of the adapter coupler by means of a special mechanism such that the drawbar eye can move in the longitudinal direction of the adapter coupler relative the tension yoke for the purpose of height centering the adapter coupler. This constitutes an especially easily-realized yet effective solution for height centering the adapter coupler. By the drawbar eye being moved in the longitudinal direction of the adapter coupler toward the first connecting area relative the tension yoke, a tractive force can be exerted on the lug of the drawhook received in the tension yoke from the drawbar eye, in consequence of which torque acts on the adapter coupler and there is thus a vertical pivoting of the adapter coupler about the tension bolt of the tension yoke relative to the drawhook.

In an advantageous development of the latter embodiment, the mechanism used to move the draw-bar eye in the longitudinal direction of the adapter coupler relative to the tension yoke comprises a first as well as a second limit stop so as to be able to limit the longitudinal movement of the drawbar eye. This thus ensures that the adapter coupler is only pivotable relative the drawhook within a pre-definable vertical angular range. The first and second limit stop are thereby to be configured in such a way that the allowable pivoting range can be selected so as to allow dynamic vehicle movements during vehicle operation.

In one preferred development of the latter embodiment, the mechanism by means of which the drawbar eye is connected to the coupler support of the adapter coupler comprises at least one spring element to pretension the drawbar eye in the direction of the second connecting mechanism. The amount of pretensioning exerted by the spring element is thereby preferably predefinable. The providing of at least one spring element enables the cushioning of the dynamic vehicle movements occurring during vehicle operation.

In a particularly preferred realization of the adapter coupler, the mechanism by means of which the drawbar eye is connected to the coupler support comprises a drawbar or the like which is movable in the longitudinal direction of the adapter coupler relative to the tension yoke, wherein the drawbar eye is fastened at the end region of the drawbar facing the second connecting mechanism. It is furthermore conceivable hereby to provide for a support preferably releasably connected to the coupler support which exhibits an opening through which the drawbar is guided. The above-cited at least one spring element is preferably arranged between the support and the end region of the drawbar facing the first connecting mechanism in order to pretension the drawbar eye toward said first connecting mechanism.

It is particularly preferred for the support to be releasably connected to the coupler housing, thereby enabling e.g. the retrofitting of an adapter coupler with a height-centering mechanism.

The support is preferably connected to the coupler housing on the upper side of the coupler housing. It is however also conceivable for the support to be connected to the coupler housing on the side of the coupler housing.

The following will reference the illustrations in the accompanying FIGS. 3 to 7 in describing embodiments of the invention in greater detail.

DETAILED DESCRIPTION OF AN ILLUSTRATIVE EMBODIMENT

Figure 1:
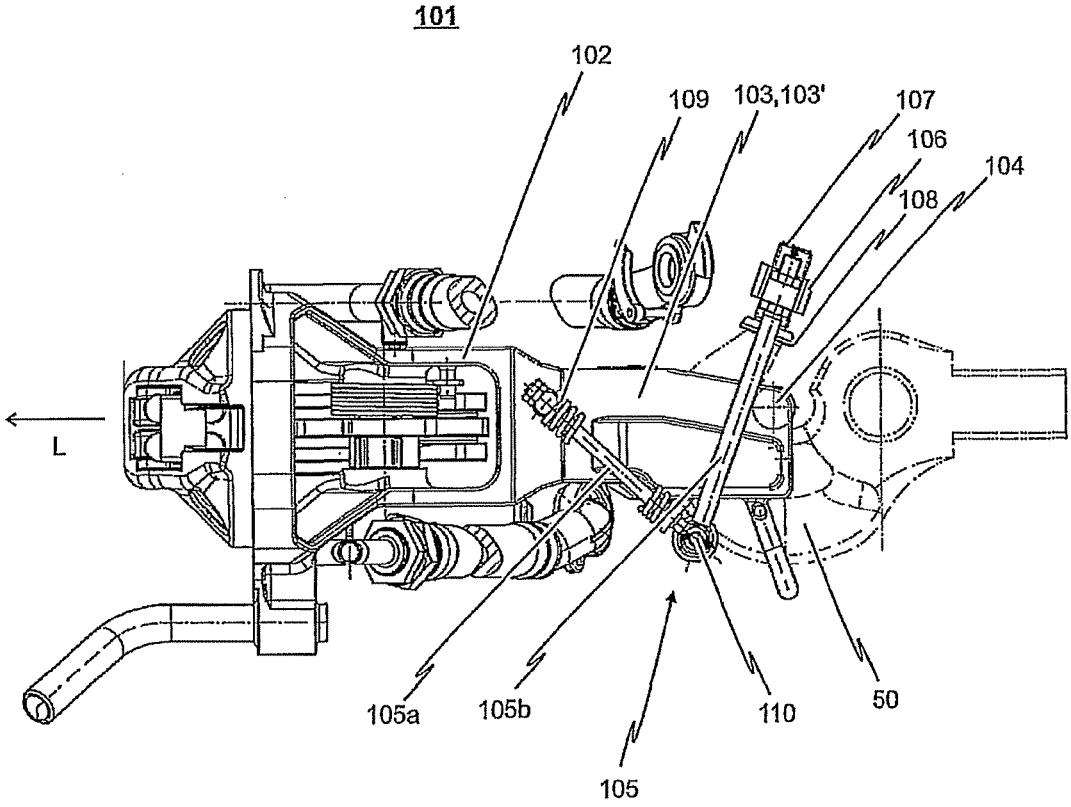
Fig. 1 Prior Art
FIG. 1 a side view of a known prior art adapter coupler.
Figure 2:
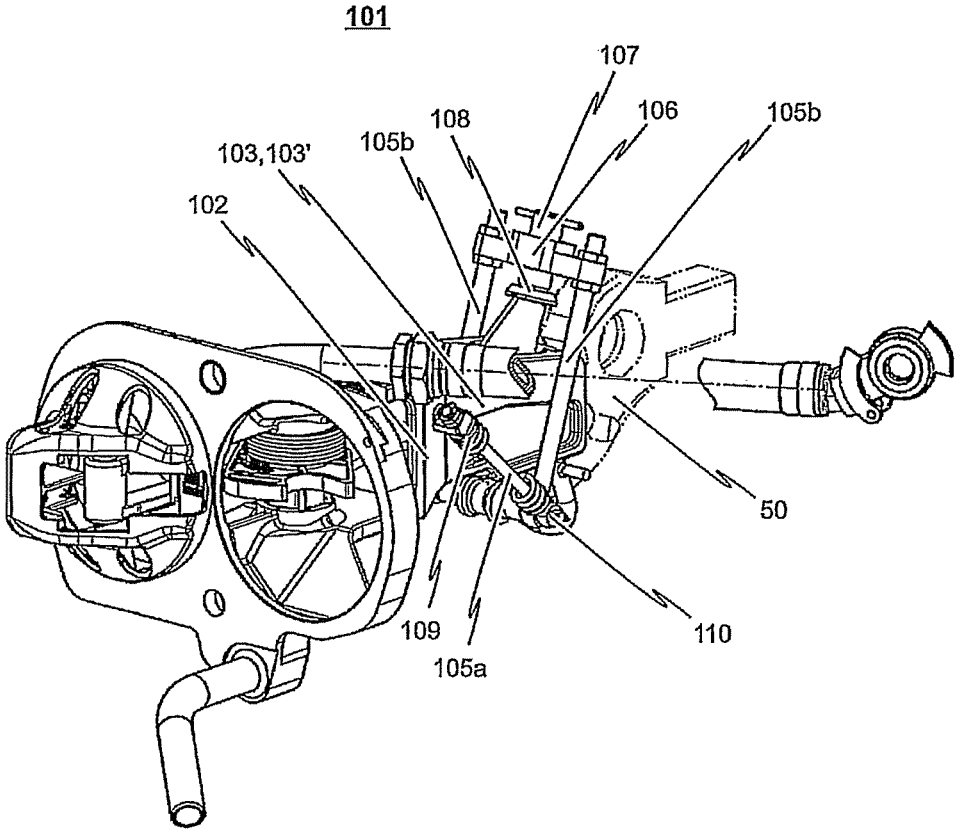
Fig. 2 Prior Art
FIG. 2 a perspective view of the known prior art adapter coupler according to FIG. 1.

FIGS. 1 and 2 show an adapter coupler 101 as known from the prior art which comprises a bell-crank lever 105 fastened to the lug of a drawhook 50 by means of a yoke 107 for height centering purposes. The bell-crank lever 105 is thereby affixed to the side of the housing 102 of the adapter coupler 101 and ensures the height centering of the adapter coupler 101.

As noted above, a disadvantage to the conventional adapter coupler 101 depicted in FIGS. 1 and 2 is that it is relatively difficult to mount the adapter coupler 101 on the drawhook 50 of a coupling to be adapted due to the relatively complicated structure of the height-centering mechanism in the form of a bell-crank lever 105. It is in particular not possible for one person to mount the adapter coupler 101 on the drawhook 50 of a coupling to be adapted by themselves, since one person alone cannot hold the adapter coupler 101 and properly position the height-centering mechanism on the drawhook 50 all at the same time.

In order to overcome this disadvantage, the invention proposes an adapter coupler 1 as will be described in greater detail below using embodiments referencing the illustrations in FIGS. 3 to 7. Specifically, FIG. 3 shows a first embodiment of the adapter coupler 1 according to the invention in a side view while FIG. 4 depicts a perspective view of the adapter coupler 1 according to the first embodiment.

Figure 3:
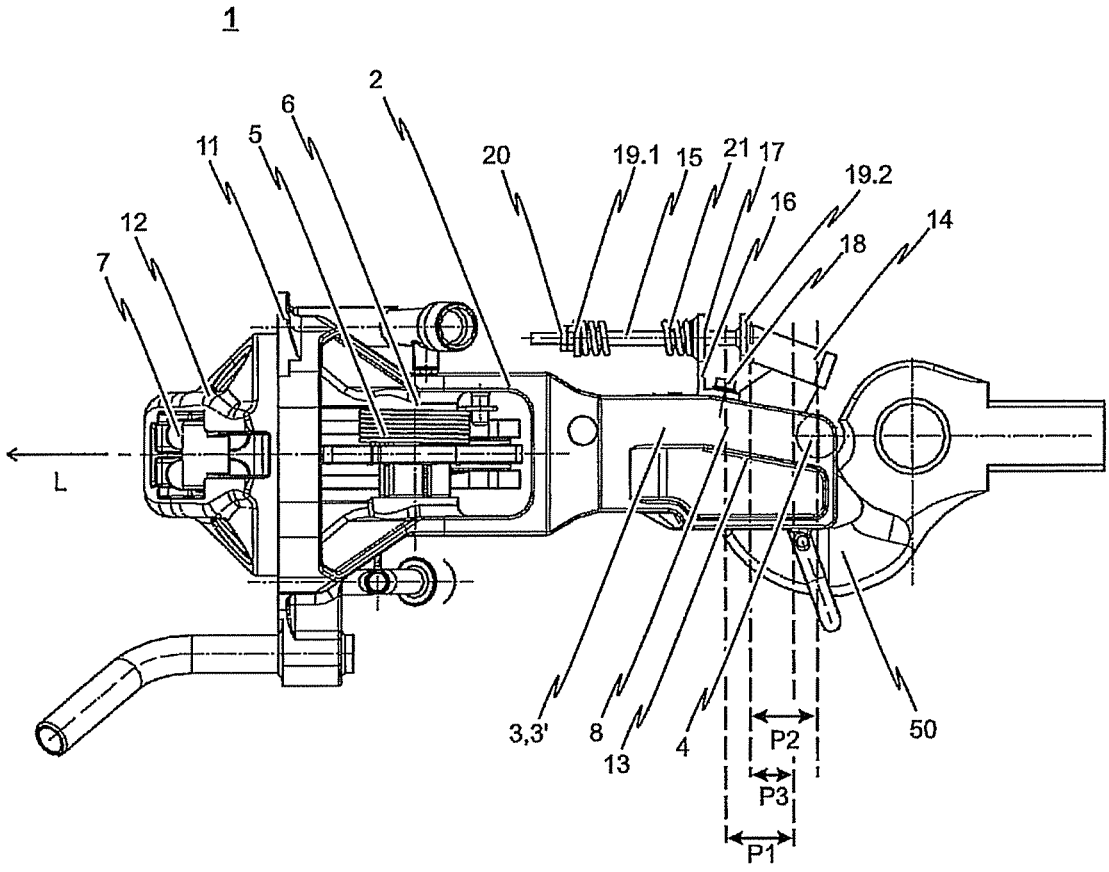
FIG. 3 a side view of an adapter coupler according to a first embodiment of the present invention.
Figure 4:
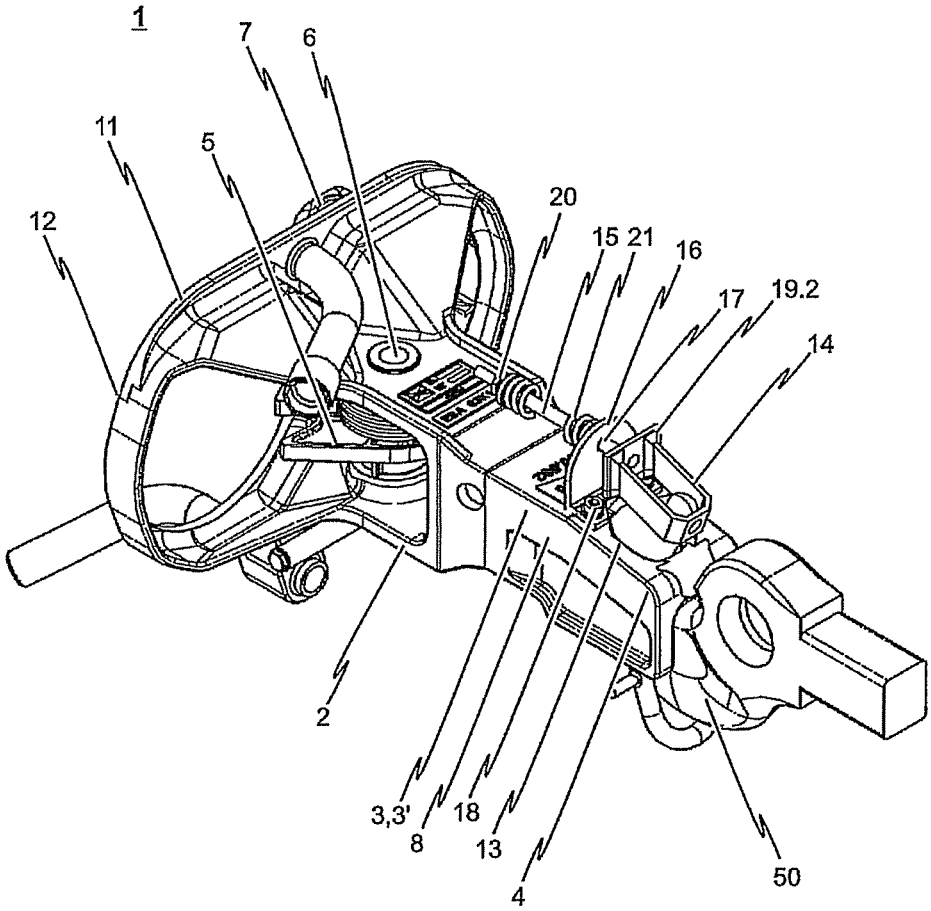
FIG. 4 a perspective view of the adapter coupler according to FIG. 3.

The embodiment of the inventive adapter coupler 1 depicted in FIGS. 3 and 4 consists of a coupler housing 2 which at least partly receives the coupling members of the adapter coupler 1. In detail, a coupler lock 5 is accommodated in the coupler housing 2 as a first connecting mechanism which serves in releasably connecting the adapter coupler 1 to the coupler head of a (not shown) automatic central buffer coupling.

In the embodiment depicted in FIGS. 3 and 4, the adapter coupler 1 is designed to couple with a Scharfenberg® automatic central buffer coupling.

Accordingly, the coupler lock 5 accommodated in the coupler housing 2 in the first embodiment as depicted comprises in particular a core piece mounted about a vertically-extending main pin 6 so as to be rotatable relative coupler housing 2. A coupling eye 7 is articulated to the core piece which serves to engage with a core piece of an automatic central buffer coupling to be coupled to adapter coupler 1.

Although it is not explicitly depicted in FIGS. 3 and 4, it is of course conceivable for the coupler lock 5 to also comprise, additionally to the above-cited core piece rotatably mounted in the coupler housing 2 about the main pin 6 and to which the coupling eye 7 is articulated, tensions springs, spring bearings and a ratchet with stem guide to allow an automatic coupling and uncoupling of the adapter coupler 1 to an automatic central buffer coupling of e.g. Scharfenberg® design. It is accordingly preferred for the coupler lock 5 accommodated in the coupler housing 2 to be designed and configured as a conventional rotary closure so as to be mechanically connectable to the coupler head of an automatic central buffer coupling in releasable fashion.

The coupler lock 5 accommodated in the coupler housing 2 serves to transmit tractive forces when the adapter coupler 1 is mechanically connected to the coupler head of an automatic central buffer coupling (not explicitly depicted in FIGS. 3 and 4). Compressive forces on the other hand are transmitted via a flat front face 11 of the coupler housing 2. As can be noted from the FIGS. 3 and 4 representations, the coupler housing 2 hereby exhibits a profile consisting of a wide, flat edge as well as conical and funnel-shaped guide surfaces. This profile aligns and centers the adapter coupler 1 relative a central buffer coupling to be mechanically connected to the adapter coupler 1, and also allows their interlocking even given tight turns and height differences.

As can be noted particularly from the FIG. 4 illustration, the coupler housing 2 of adapter coupler 1 can comprise a front face 11 integrally formed with the coupler housing 2 or formed separately from and bolted to the coupler housing 2. Front face 11 preferably exhibits a funnel to receive the drawbar eye of an automatic central buffer coupling to be mechanically connected to the adapter coupler 1. A cone 12 is further provided on the front face 11 of the coupler housing 2 next to the funnel formed in said front face 11 of the coupler housing in the adapter coupler 1 depicted in FIGS. 3 and 4. Hence, the front face 11 of the adapter coupler 1 exhibits a profile which is compatible with the profile of a coupler head of an automatic central buffer coupling.

A tension yoke 8 is configured in the end region of the adapter coupler 1 opposite the front face 11 of the coupler housing 2—as can be seen in the FIGS. 3 and 4 illustrations—which can be inserted into the drawhook 50 of e.g. a screw-type coupling to releasably connect the adapter coupler 1 to the screw-type coupling. A corresponding recess 13 running the longitudinal axis L of adapter coupler 1 is hereto configured in the end region of the adapter coupler 1 opposite the front face 11 of the coupler housing 2.

In the first embodiment of the inventive adapter coupler 1 depicted in FIGS. 3 and 4, two parallel-extending supports 3, 3' to the longitudinal direction of adapter coupler 1 are provided in the end region of the adapter coupler 1 opposite the front face 11 of the coupler housing 2 which are connected together by means of a horizontally-extending tension bolt 4 to form the tension yoke 8 at the end region of the adapter coupler 1. The drawhook 50 of the screw-type coupling can be brought into engagement with the tension yoke 8 by—as depicted in FIGS. 3 and 4—the drawhook 50 being received in the recess 13 between the two parallel supports 3, 3'.

Of course it is not imperative for the two supports 3, 3' to be in parallel alignment with each other. It is in particular conceivable for them to extend slightly diagonal to one another.

To have the adapter coupler 1 assume a vertical dead center position for smooth coupling and maintain this position during coupling, the adapter coupler 1 incorporates height centering. An essential component of said height centering is a drawbar eye 14 connected to the coupler housing 2 which—as depicted in FIGS. 3 and 4—aligns at least partly with the recess 13 of the tension yoke 8 and serves to receive at least the lug of the drawhook 50 when the drawhook 50 of the coupling to be adapted engages with the tension yoke 8 of the adapter coupler 1. Specifically, and as can especially be seen in the FIG. 4 illustration, the drawbar eye 14 in the embodiment is provided on the upper side of the coupler housing 2 and aligns at least partly substantially axially with the area between the two parallel supports 3, 3' forming the tension yoke 8 at the end region of the adapter coupler 1. What this measure accomplishes is the automatic receiving of the lug of the drawhook 50 in the drawbar eye 14 of the height centering when the tension yoke 8 of the adapter coupler 1 is inserted into the drawhook 50 of the screw-type coupling to be adapted.

It can be noted from the FIG. 3 illustration that in the first embodiment of the inventive adapter coupler 1, the drawbar eye 14 is configured and aligned relative to the accommodation formed by the tension yoke 8 such that the parallel projection P1 of the drawbar eye 14 and the parallel projection P2 of the accommodation at least partly overlap on a horizontal plane of projection. The overlap is indicated in FIG. 3 by reference numeral "P3."

In the embodiment depicted in FIGS. 3 and 4, the drawbar eye 14 of the height centering is specifically connected to the coupler housing 2 of the adapter coupler 1 by means of a mechanism such that the drawbar eye 14 is movable in the longitudinal direction L of the adapter coupler 1 relative to the tension yoke 8 to realize the height centering of adapter coupler 1. In the depicted embodiment, a drawbar 15 movable in the longitudinal direction L of adapter coupler 1 relative tension yoke 8 is used for this purpose, whereby the drawbar eye 14 is affixed to the end region of the drawbar 15 facing the screw-type coupling. Said drawbar 15 itself runs substantially parallel to the longitudinal direction L of the adapter coupler 1. The drawbar 15 together with the tension yoke 8 fastened to an end region of the drawbar 15 is movable in the longitudinal direction L of the adapter coupler 1 relative the tension yoke 8. To this end, the drawbar 15 is guided through an opening 17 provided in a support 16 connected to the coupler housing 2. In the embodiment of the inventive adapter coupler 1 as depicted, the support 16 itself is releasably fastened to the upper side of the coupler housing 2 by means of a bolted connection 18. Of course it is also conceivable for the support 16 to be welded to the upper side of the coupler housing 2 or affixed in some other manner.

As FIGS. 3 and 4 show, the movement of the drawbar eye 14 in the longitudinal direction L of the adapter coupler 1 relative to the tension yoke 8 is restricted by means of a first limit stop 19.1 on the one side and a second limit stop 19.2 on the other. The first limit stop 19.1 is provided at the end region of the drawbar 15 facing the screw-type coupling. The second limit stop 19.2 is formed by a nut 20 screwed onto the opposite end region of the drawbar 15. In detail, the movement of the drawbar eye 14 in the longitudinal direction L of the adapter coupler 1 relative to the tension yoke 8 is on the one side limited by the first limit stop 19.1 striking the face of the support 16 and, on the other side, the movement of the drawbar eye 14 in the longitudinal direction L of the adapter coupler 1 is limited by the second limit stop 19.2 striking the facing front face of the support 16.

In order for the height centering to achieve a relative damping compensating of the dynamic vehicle movements between the adapter coupler 1 and a screw-type coupling during vehicle operation with the inventive solution, the height centering further comprises a spring element 21 in the form of a pressure spring. Specifically, in the embodiment depicted in FIGS. 3 and 4, the spring element 21 is pretensioned between the nut 20 and the support 16.

By displacing the nut 20, the drawbar 15 together with the drawbar eye 14 attached thereto is displaced in the longitudinal direction L of the adapter coupler 1 relative to the coupler housing 2 by the compressive force exerted by the spring element on the support 16. In this way, the vertical angular position of the adapter coupler 1 about bolt 4, and thus the central position of adapter coupler 101, can be set.

Figure 5A:
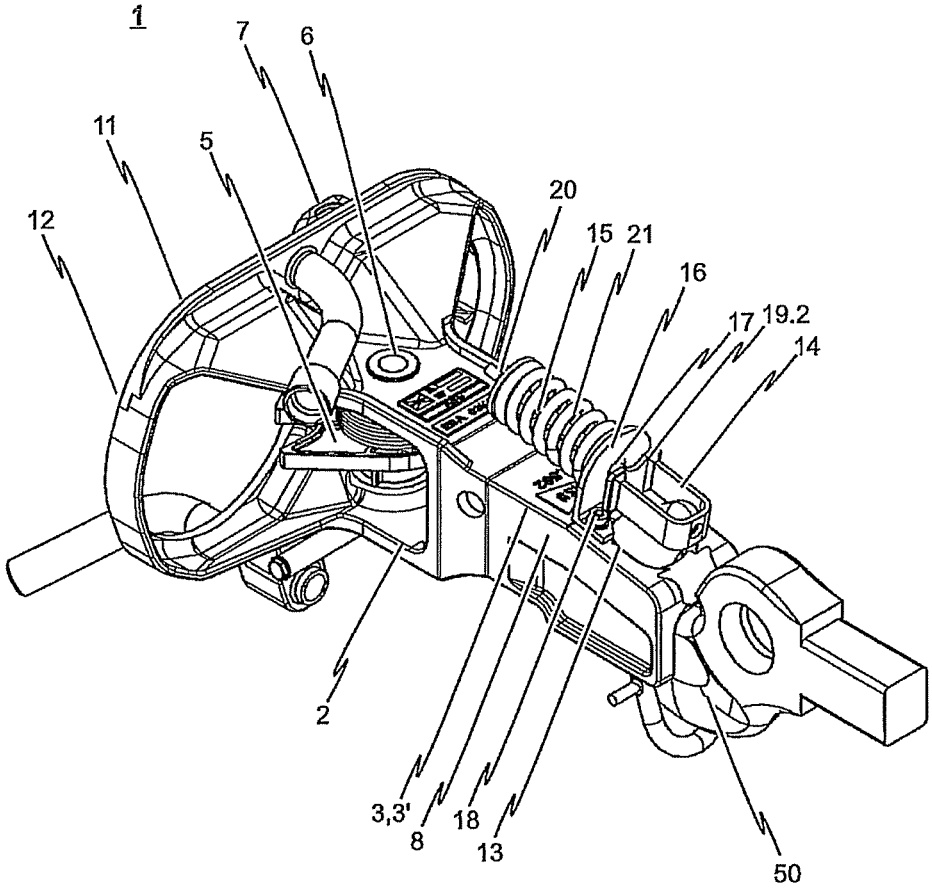
FIG. 5*a* a first perspective view of an adapter coupler according to a second embodiment of the present invention.
Figure 5B:
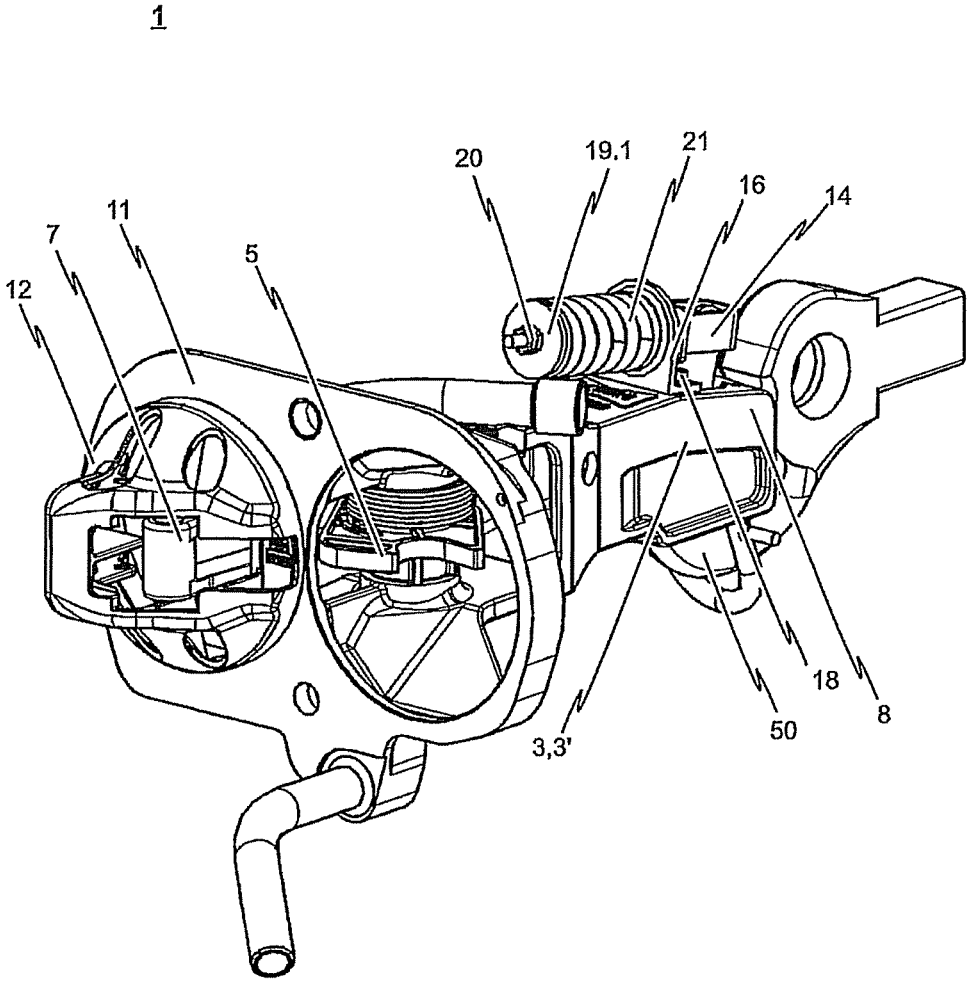
FIG. 5*b* a second perspective view of the adapter coupler according to the second embodiment of the present invention.
Figure 6:
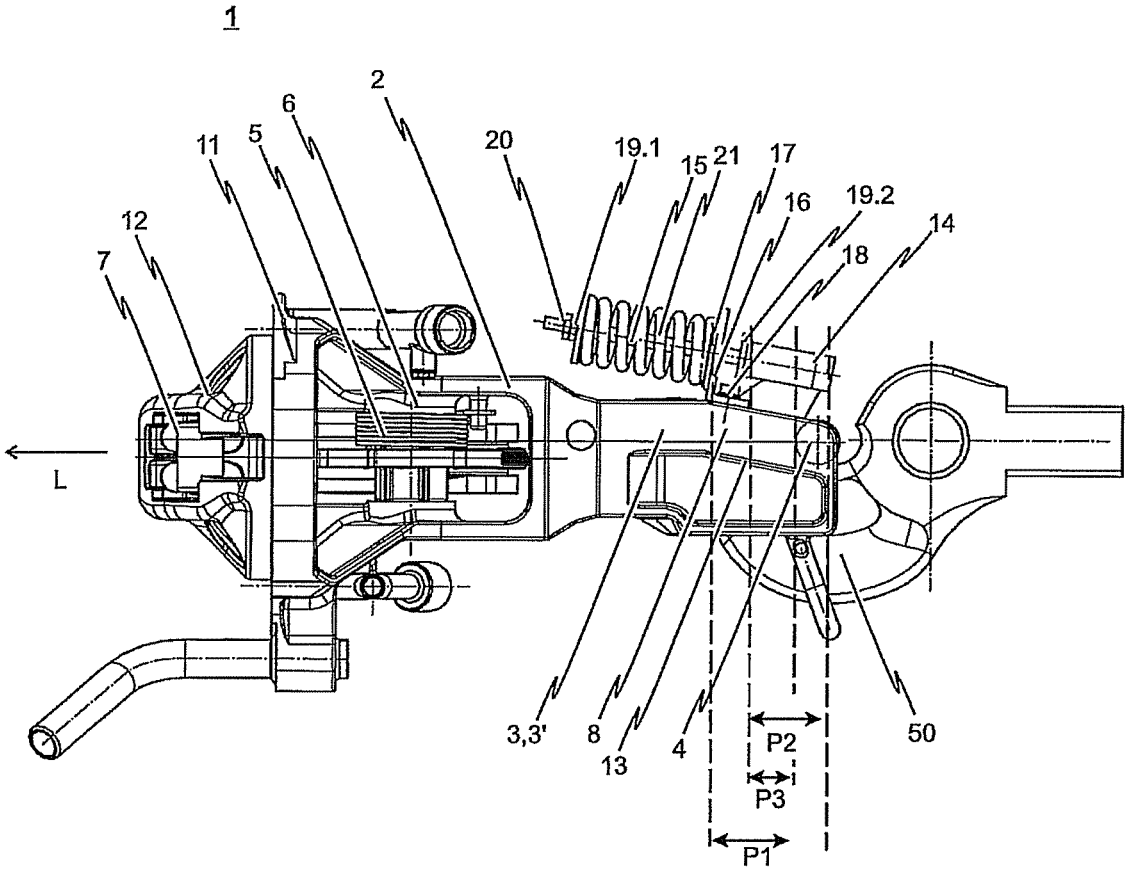
FIG. 6 a side view of the adapter coupler according to the second embodiment of the present invention.
Figure 7:
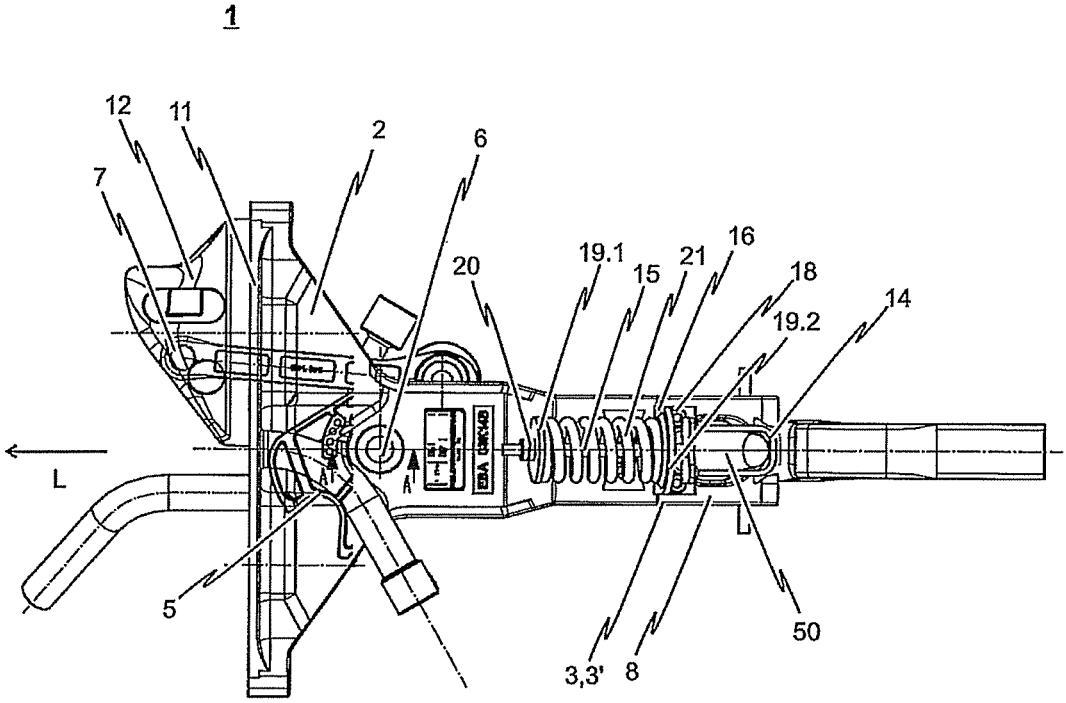
FIG. 7 a top plan view of the adapter coupler according to the second embodiment of the present invention.

A second embodiment of the inventive adapter coupler 1 will be described below referencing the illustrations in FIGS. 5 to 7. Specifically, FIGS. 5*a* and 5*b* both show a perspective representation of the second embodiment of the adapter coupler 1. FIG. 6 shows a side view of the adapter coupler 1 according to the second embodiment while FIG. 7 shows a top plan view of said adapter coupler 1.

The adapter coupler 1 according to the second embodiment is of similar structural and functional configuration to the first embodiment. The difference between the adapter coupler 1 according to the second embodiment and the adapter coupler according to the first embodiment can in particular be seen in that in the second embodiment, the position of the height adjustment is configured differently with respect to the coupler housing 2 of the adapter coupler 1. Specifically, the drawbar 15 no longer extends horizontally in the second embodiment as it does in the first embodiment but rather at a slight angle. However, the drawbar eye 14 is still configured and aligned relative the accommodation formed by tension yoke 8 such that the parallel projection P1 of the drawbar eye 14 partly overlaps the parallel projection P2 of the accommodation on a horizontal plane of projection, as can be seen in the FIG. 6 illustration.

Apart from that, the further components of the adapter coupler 1 according to the second embodiment correspond to the components of the first embodiment so that reference is made at this point to the remarks given earlier so as to avoid repetition.

The invention is not limited to the embodiments of the adapter coupler described above in reference to the FIGS. 3 to 7 illustrations, but rather yields from a consideration of all the features disclosed herein as a whole. It is in particular conceivable for the support 16 not to be preferably releasably connected to the upper side of the coupler housing 2, but rather preferably releasably connected to coupler housing 2 at the side of said coupler housing 2.

Other designs are also conceivable for the aligning of the drawbar eye 14. It would for example be feasible to provide a pivoting mechanism to move the drawbar eye 14 in the longitudinal direction L of the adapter coupler 1 relative to the tension yoke 8.

LIST OF REFERENCE NUMERALS

1 adapter coupler
2 coupler housing
3 first support
3' second support
4 tension bolt
5 coupling member/coupler lock
6 coupling member/main pin
7 coupling member/coupling eye
8 tension yoke
11 front face
12 cone
13 recess
14 drawbar eye
15 (movable) drawbar
16 support
17 opening
18 bolted connection
19.1 first limit stop
19.2 second limit stop
20 nut
21 spring element

50 drawhook
101 adapter coupler
102 housing
103 support
103' support
104 pin
105 bell-crank lever
105*a* first limb
105*b* second limb
106 positioning nut
107 yoke
108 crosspiece
109 pressure spring
110 shank
L longitudinal direction
P1 parallel projection
P2 parallel projection
P3 overlap

What is claimed is:

1. An adapter coupler for adapting couplings of different design, wherein the adapter coupler comprises the following:

a first connecting mechanism for a releasable connecting of the adapter coupler to a first coupling;

a second connecting mechanism for a releasable connecting of the adapter coupler to a drawhook of a second coupling, the second connecting mechanism comprising a tension yoke with a first and a second support connectable to a tension bolt such that an accommodation is formed to receive the drawhook of the second coupling;

a coupler housing for connecting the first connecting mechanism to the second connecting mechanism; and a mechanism for height centering which incorporates a drawbar eye connected to the coupler housing, the drawbar eye connecting to the coupler housing by means of a mechanism such that the drawbar eye can move in a longitudinal direction of the adapter coupler relative to the tension yoke for a purpose of height centering the adapter coupler, the mechanism comprising a drawbar which is movable in the longitudinal direction of the adapter coupler relative to the tension yoke to which an end region of the drawbar eye facing the second connecting mechanism is affixed, the mechanism further comprising a support connected to the coupler housing having an opening through which the drawbar is guided wherein the support is connected to the coupler housing at an upper side or a side of the coupler housing, and a spring element arranged between the support and the end region of the drawbar facing the first connecting mechanism to pretension the drawbar eye in a direction of said first connecting mechanism.

2. The adapter coupler according to claim 1, wherein the drawbar eye is configured and aligned relative to the accommodation formed by the tension yoke such that a parallel projection of the drawbar eye and a parallel projection of the accommodation at least partly overlap on a horizontal plane of projection.

3. The adapter coupler according to claim 2, wherein the first and second support extend parallel to one another, and wherein the tension bolt extends horizontally, whereby the drawhook of the second coupling is received in an area between the two parallel supports.

4. The adapter coupler according to claim 1, wherein the drawbar eye is provided above the coupler housing and is aligned with an area between the first and second support.

5. The adapter coupler according to claim 4, wherein the coupler housing is substantially axially aligned with the area between the first and second support.

6. The adapter coupler according to claim 2, wherein the drawbar eye is connected to the coupler housing by means of a mechanism such that the drawbar eye can move in the longitudinal direction of the adapter coupler relative to the tension yoke for the purpose of height centering the adapter coupler.

7. The adapter coupler according to claim 6, wherein the mechanism for height centering comprises a first limit stop and a second limit stop to limit a movement of the drawbar eye in the longitudinal direction of the adapter coupler relative the tension yoke.

8. The adapter coupler according to claim 7, wherein the mechanism comprises a spring element to pretension the drawbar eye in a direction of the second connecting mechanism.

9. The adapter coupler according to claim 6, wherein the mechanism for height centering comprises a drawbar which is movable in a longitudinal direction of the adapter coupler relative to the tension yoke to which the end region of the drawbar eye facing the second connecting mechanism is affixed.

10. The adapter coupler according to claim 9, wherein the mechanism further comprises a support connected to the coupler housing having an opening through which the drawbar is guided.

11. The adapter coupler according to claim 10, wherein the support is releasably connected to the coupler housing.

12. The adapter coupler according to claim 10, wherein the support is connected to the coupler housing at an upper side or a side of the coupler housing.

13. The adapter coupler according to claim 12, wherein the support is releasably connected to the coupler housing.

14. The adapter coupler according to claim 12, wherein a spring element is arranged between the support and the end region of the drawbar facing the first connecting mechanism to pretension the drawbar eye in the direction of said first connecting mechanism.

15. The adapter coupler according to claim 14, wherein a nut is arranged on the end region of the drawbar facing the first connecting mechanism such that the spring element is pretensioned between the nut and the support.

16. The adapter coupler according to claim 15, wherein the coupler housing is at least partly configured to receive a coupling members of the first connecting mechanism.

17. The adapter coupler according to claim 1, wherein the first and second support extend parallel to one another, and wherein the tension bolt extends horizontally, whereby the drawhook of the second coupling is received in an area between the two parallel supports.

18. The adapter coupler according to claim 1, wherein the drawbar eye is provided above the coupler housing and is aligned with an area between the first and second support.

19. The adapter coupler according to claim 18, wherein the coupler housing is substantially axially aligned with the area between the first and second support.

20. The adapter coupler according to claim 1, wherein the mechanism for height centering comprises a first limit stop and a second limit stop to limit a movement of the drawbar eye in the longitudinal direction of the adapter coupler relative the tension yoke.

21. The adapter coupler according to claim 1, wherein the mechanism comprises a spring element to pretension the drawbar eye in a direction of the second connecting mechanism.

22. The adapter coupler according to claim 21, wherein the amount of pretensioning exerted by the spring element is predefinable.

23. The adapter coupler according to claim 1, wherein a nut is arranged on the end region of the drawbar facing the first connecting mechanism such that the spring element is pretensioned between the nut and the support.

24. The adapter coupler according to claim 1, wherein the first connecting mechanism is designed to enable a releasable connecting of the adapter coupler to an automatic central buffer coupling, particularly a central buffer coupling having a coupler front face profile with a cone and a funnel.

25. The adapter coupler according to claim 1, wherein the coupler housing is at least partly configured to receive the coupling members of the first connecting mechanism.

* * * * *